US009502832B1

(12) United States Patent
Ullahkhan et al.

(10) Patent No.: US 9,502,832 B1
(45) Date of Patent: Nov. 22, 2016

(54) DUPLEX RECEPTACLE HAVING A PLURALITY OF LEDS TO ILLUMINATE THE SOCKETS

(71) Applicants: Mustafa Majeed Ullahkhan, Westland, MI (US); Heena Tabassum Khan, Westland, MI (US)

(72) Inventors: Mustafa Majeed Ullahkhan, Westland, MI (US); Heena Tabassum Khan, Westland, MI (US)

( * ) Notice: Subject to any disclaimer, the term of this patent is extended or adjusted under 35 U.S.C. 154(b) by 0 days.

(21) Appl. No.: 15/084,854

(22) Filed: Mar. 30, 2016

Related U.S. Application Data

(60) Provisional application No. 62/264,272, filed on Dec. 7, 2015.

(51) Int. Cl.

| | |
|---|---|
| ***H01R 13/648*** | (2006.01) |
| ***H01R 4/66*** | (2006.01) |
| ***H01R 13/717*** | (2006.01) |
| ***H01R 24/78*** | (2011.01) |
| ***H01R 25/00*** | (2006.01) |
| *H01R 103/00* | (2006.01) |

(52) U.S. Cl.
CPC ..... *H01R 13/7175* (2013.01); *H01R 24/78* (2013.01); *H01R 25/006* (2013.01); *H01R 2103/00* (2013.01)

(58) Field of Classification Search
CPC ..... H01R 3/00; H01R 4/66; H01R 13/60; H01R 13/6395; H01R 13/648; H01R 13/66; H01R 13/717; H01R 13/7175; H01R 24/78; H01R 24/525; H01R 25/006
USPC ..... 439/107, 490, 535
See application file for complete search history.

(56) References Cited

U.S. PATENT DOCUMENTS

| | | | | |
|---|---|---|---|---|
| 1,720,463 | A | 7/1929 | Both | |
| 2,015,698 | A | 10/1935 | Tiffany | |
| 2,863,038 | A | 12/1958 | Lombardo | |
| 3,265,888 | A | 8/1966 | Adolphson | |
| 3,307,030 | A | 2/1967 | DeFrancisco | |
| 3,739,226 | A | 6/1973 | Seiter et al. | |
| 3,895,225 | A | 7/1975 | Prior | |
| 4,617,613 | A | 10/1986 | Rice | |
| 4,774,641 | A | 9/1988 | Rice | |
| D330,267 | S | 10/1992 | Hendrix | |
| D342,581 | S | 12/1993 | Reynolds | |
| 5,413,501 | A | 5/1995 | Munn | |
| 5,683,166 | A | 11/1997 | Lutzker | |
| 5,816,682 | A | 10/1998 | Marischen | |
| 6,089,893 | A * | 7/2000 | Yu | H01R 13/717 362/95 |
| 6,109,760 | A | 8/2000 | Salatrik et al. | |
| 7,036,948 | B1 | 5/2006 | Wyatt | |
| 7,204,696 | B1 * | 4/2007 | Libby, II | H01R 13/70 200/51 R |
| D603,983 | S | 11/2009 | Richter et al. | |
| D603,984 | S | 11/2009 | Richter et al. | |
| D603,985 | S | 11/2009 | Richter et al. | |

(Continued)

*Primary Examiner* — Chandrika Prasad
(74) *Attorney, Agent, or Firm* — Thomas P. Heed

(57) ABSTRACT

An illuminated duplex receptacle allows a small amount of light to escape from both the upper and lower sets of receiving sockets. The present invention adds to a standard duplex outlet by placing two light emitting diodes ("LEDs") inside the plastic housing. One LED is placed behind the electrodes for the upper set of sockets. One LED is placed behind the electrodes for the lower set of sockets. The electrodes are interposed between the LEDs and the receiving sockets. In this way, only a small amount of indirect light filters out of the receiving sockets. In one embodiment, the LEDs run at one-quarter watt or less of continuous power. In an alternative embodiment, the housing is translucent, and the LEDs run at one watt or more of continuous power.

14 Claims, 7 Drawing Sheets

(56) References Cited

U.S. PATENT DOCUMENTS

| | | | | |
|---|---|---|---|---|
| D604,873 | S | 11/2009 | Richter et al. | |
| 7,726,825 | B2 | 6/2010 | Mandapat et al. | |
| 7,736,174 | B2 | 6/2010 | Bhosale et al. | |
| 7,862,350 | B2 * | 1/2011 | Richter | H01H 9/182 362/95 |
| D634,866 | S | 3/2011 | Richter et al. | |
| 7,918,667 | B1 | 4/2011 | Shim | |
| 8,105,106 | B1 | 1/2012 | Stoddard | |
| 8,194,368 | B2 | 6/2012 | Weeks et al. | |
| 8,304,652 | B2 | 11/2012 | McBain | |
| D674,753 | S | 1/2013 | Jansen et al. | |
| 8,371,863 | B1 * | 2/2013 | Ganta | H02G 3/105 439/107 |
| 8,393,747 | B2 | 3/2013 | Kevelos et al. | |
| 8,444,309 | B2 | 5/2013 | Jensen et al. | |
| 8,770,424 | B1 | 7/2014 | Shaw | |
| 9,112,321 | B2 | 8/2015 | Bhosale et al. | |
| 9,175,815 | B2 | 11/2015 | Padro | |
| 2002/0131262 | A1 | 9/2002 | Amburgey | |
| 2003/0092297 | A1 | 5/2003 | Reindel et al. | |
| 2007/0251712 | A1 * | 11/2007 | Berg | H01R 13/465 174/53 |
| 2009/0052162 | A1 * | 2/2009 | Richter | H01H 9/182 362/95 |
| 2010/0227484 | A1 * | 9/2010 | Arenas | H01R 9/2491 439/107 |
| 2010/0261373 | A1 * | 10/2010 | Roneker | H01R 13/641 439/488 |
| 2012/0039086 | A1 * | 2/2012 | Jansen | H01H 9/182 362/551 |
| 2016/0219741 | A1 * | 7/2016 | Chen | H05K 7/1015 |
| 2016/0285216 | * | 9/2016 | Bury et al. | H01R 25/006 |

* cited by examiner

DUPLEX RECEPTACLE HAVING A PLURALITY OF LEDS TO ILLUMINATE THE SOCKETS

CLAIM OF PRIORITY

This U.S. utility patent application is a non-provisional U.S. utility patent application of a provisional U.S. utility application No. 62/264,272, filed Dec. 7, 2015.

FIELD OF INVENTION

This invention relates to the class of electrical connectors. Specifically, this invention relates to the outlet box.

BACKGROUND OF INVENTION

The most common electrical outlet in the United States is the duplex receptacle. The duplex receptacle has receiving sockets into which the plug prongs of an appliance snuggly fit. Typically, a duplex receptacle has two rectangular or slotted receiving sockets and one arch-shaped receiving socket. Typically, one of the two slotted receiving sockets is larger than the other. This is a polarized receptacle, where the larger slot is the neutral terminal and the smaller slot is the hot terminal. It accommodates appliances that have polarized plugs. The arch-shaped slot is a ground slot, for use with a plug that has a ground prong.

The National Electrical Manufacturers' Association ("NEMA") has a standard specification, WD6-2002, for the height, width, and depth of a duplex receptacle. In order to retrofit a duplex receptacle into existing construction, it must comply with the dimensional specifications of WD6-2002. In order to be included in new construction, a duplex receptacle must comply with the dimensional specifications of WD6-2002.

The duplex receptacle is generally installed in a duplex outlet housing box that is attached to a wall stud. A duplex receptacle is wired to a building by attaching the hot wire to the hot terminal, and the neutral wire to the neutral terminal. If the duplex receptacle is in an area that might get wet, most building codes require a Ground Fault Circuit Interrupter ("GFCI"). A GFCI has an additional attachment to the home or commercial building: it has a ground wire. Otherwise, the GFCI is dimensionally the same as other duplex receptacles. A duplex receptacle is covered by a face plate, in order to cover the wires. Due to standardization, the cost of the duplex receptacle is very low, with units starting at less than $1.00 at wholesale.

There are many situations in which a person wants to plug an electrical appliance into a duplex receptacle in a room which is dark. The person must either turn on lights in the darkened room, or fumble about trying to find the duplex receptacle. Many times, in order not to disturb those that are sleeping, such as a child or spouse, a person will choose not to turn on the light. In many cases, a room can be so dark that even the outline of the duplex receptacle is indiscernible. Finding the duplex receptacle in a dark room can be difficult, as the person must correctly identify the position of the outlet in the room, overall. Additionally, the person must search at the right height. Electrical outlets that are hidden, or partially hidden, due to furniture placement make the problem even more difficult.

Once the duplex receptacle is located, plugging in an appliance can be challenging. In the dark, it is difficult to correctly align the spades or prongs of the plug with the corresponding openings of the duplex receptacle; especially with respect to polarized plugs (i.e., plugs in which one spade is larger than the other). What is easy in a lighted room—spatially aligning the spades of a plug, with the correct orientation, to a duplex receptacle—can be daunting in the dark. To help with overcoming this issue some consumers expose themselves to electric shock by trying to feel the location of the prongs with their naked fingers, in order to help with proper insertion of the plug.

In addition to convenience, there are some safety issues to consider. A person can shock themselves feeling around for an electrical outlet. A person can easily shock themselves guiding the prongs into the electrical outlet. Additionally, a person can injure themselves bumping into things in a darkened room, or tripping over cords that are already plugged into the duplex receptacle.

What is needed is a duplex receptacle that is backlit so that the receiving sockets are apparent in a darkened room. Such a solution would not, necessarily, act as a nightlight, as it would not add a significant amount of ambient light to the room. Additionally, such a solution would have a very low overall power draw.

PRIOR ART REVIEW

The prior art contains many examples of solutions which attempt to solve the problem of safely plugging in an appliance, into a duplex receptacle, in a darkened room. There is prior art related to using nightlights of various constructions and varieties, which can partially solve the problem: for example, U.S. Utility Pat. No. 8,194,368, by named inventors Weeks, et. al, entitled, "Protective electrical wiring device with a center nightlight," (teaches a WD6-2002 GFCI with an integral nightlight); U.S. Utility Pat. No. 5,816,682, by named inventor Marischen entitled, "Electrical receptacle faceplate with built-in nightlight," (teaches a faceplate for a duplex receptacle that has a built-in nightlight); U.S. Utility Patent Application Publication No. 2002/0131262, by named inventor Amburgey, entitled, "Surface mounted night light and socket assembly," (teaches a plug-in nightlight that takes up one of the outlets in a duplex receptacle); U.S. Design Pat. Nos. D330,267, D342, 581, both by named inventor Hendrix, both entitled, "Nightlight duplex outlet cover," (ornamental design for a nightlight built into a duplex outlet cover); and "U.S. Design Pat. Nos. D603,983, D603,984, D603,985, D604,873, and D634, 866, all by named inventors Richter, et. al., and all entitled, "Nightlight for an electrical device," (ornamental designs for a nightlight on top of the duplex receptacle).

There is substantial additional prior art that teaches incorporating a light into the duplex receptacle itself: for example, U.S. Utility Pat. No. 3,895,225, by named inventor Prior, entitled, "Illuminated receptacle with removable lens," (teaches a lamp and lense mounted between the two receptacles of standard duplex outlet); U.S. Utility Pat. No. 7,862,350, by named inventors Richter, et. al., entitled, "Combination device including a guide light and an electrical component," (teaches a lamp and lens mounted in an electrical receptacle); U.S. Utility Pat. No. 7,918,667, by named inventor Shim, entitled, "Electrical wall outlet with LED indicator," (teaches a receptacle with LEDs on the faceplate); U.S. Utility Pat. No. 8,393,747, by named inventors Kevelos, et. al., entitled, "Faceplate guidelight system," (teaches a receptacle that has side-loaded LEDs, and a faceplate that has lightpipes that illuminate the faceplate and receptacles); U.S. Utility Pat. No. 8,444,309, by named inventors Jensen, et. al., entitled, "Wiring device with illumination," (teaches a GFCI duplex receptacle with side lamps on its face); and, U.S. Utility Pat. No. 9,175,815, by named inventor Padro, entitled, "Lighted electrical device and receptacle," (teaches a duplex receptacle with a lamp between the receptacles).

There is also prior art that teaches lighting the receiving sockets within the receptacle, themselves, in an attempt to provide suitable illumination for plugging an appliance into the duplex outlet in the dark. Most of these are not meeting the market need because they either provide too much ambient light, they cost too much, or they, in some fashion, fail to solve the problem of providing a suitable illumination for the receiving sockets of a duplex receptacle. For example, U.S. Utility Pat. No. 6,109,760, by named inventors Salatrik, et. al., entitled, "Illuminated power outlet," teaches a lighted cigarette lighter receptacle using a LED, mounted behind an aperture, to allow light through, but does not teach how this would be applied to a duplex receptacle. U.S. Utility Pat. No. 7,036,948, by named inventor Wyatt, entitled, "Illuminated electrical outlet and light switch," teaches using an illuminated ring, or lightpipe, around the receptacles, which serves more to illuminate the room than the receiving sockets within the receptacle. U.S. Utility Pat. No. 7,726,825, by named inventors Mandapat, et. al., entitled, "Lighted power outlet system and method," teaches a power strip with LEDs, or other illuminating sources, within the housing so that light escapes through the receiving sockets, but it does not teach how this would be applied, economically, to a duplex receptacle. U.S. Utility Pat. No. 7,736,174, by named inventors Bhosole, et. al. ("Bhosole '174"), entitled, "Illuminated face receptacle structure," teaches a small PCB with LEDs, centralized between the receptacles, that uses apertures to illuminate the faces of the receptacles. Bhosole '174 is complex and expensive. Additionally, its method of shining light would act very much like a nightlight, without actually illuminating the inside of the receiving sockets. U.S. Utility Pat. No. 9,112,321, by named inventors Bhosole, et. al. ("Bhosole '321"), entitled, "Illuminated receptacle," teaches a modified version of Bhosole '174, in which the small PCB with LEDs, centralized between the receptacles, uses apertures to illuminate the receiving sockets. Bhosole '321 suffers from uneven lighting and complex construction. Additionally, Bhosole '321 still emits too much ambient light. Finally, there is U.S. Utility Patent Application Publication No. 2003/0092297, by named inventors Reindel, et. al. ("Reindel '297"), entitled, "Convenience light with supplemental electrical outlet," teaches replacing a standard duplex receptacle with a device that has illumination and a duplex receptacle. Reindel '297 discloses a device that illuminates and has a controller, to control the illumination. Reindel '297 is essentially a glowing nightlight and duplex receptacle, combined. There is clearly still a need for a cost-effective duplex receptacle with illuminated sockets, which does not add significant ambient light to a room.

SUMMARY OF THE INVENTION

This summary is intended to disclose the present invention, a duplex receptacle with illuminated sockets, which does not add significant ambient light into its surroundings. The embodiments and descriptions are used to illustrate the invention and its utility, and are not intended to limit the invention or its use. A standard duplex outlet consists of a housing with two sets of receiving sockets; one upper and one lower. Inside the receiving sockets are electrodes. The electrodes are connected to the hot and neutral wires. In a polarized duplex receptacle, the larger slotted socket for each set is attached to the neutral terminal, while the smaller socket is attached to the hot terminal.

The present invention allows a small amount of light to escape from both the upper and lower sets of receiving sockets. The present invention adds to a standard duplex outlet by placing two light emitting diodes ("LEDs") inside the plastic housing. One LED is placed behind the electrodes for the upper set of sockets. One LED is placed behind the electrodes for the lower set of sockets. The electrodes are interposed between the LEDs and the receiving sockets. In this way, only indirect light filters out of the receiving sockets.

A simple LED circuit, with two LEDs on it, wires directly into the terminals of the duplex receptacle. The circuit uses two light emitting diodes (LED) in conjunction with a capacitor coupled full wave rectifier circuit. The circuit uses a filtering resistor and capacitor, to properly limit the power supplied to the LEDs. The LEDs can be white or colored, such as red, blue, or green. A blue LED circuit would be perceived to give off the minimum amount of ambient light, while still highlighting the receiving sockets.

The circuit draws less than one quarter of one watt of power and can therefore run continuously. The low power draw means that the mean time to failure for the LED circuit will be greater than the mean time to failure for a standard duplex receptacle.

In an alternative embodiment, the present invention can be constructed with a translucent plastic housing body, so that it acts as a nightlight. Such a use would entail minor changes to the circuit, as shown. A photosensor would be added to shut off the light during the day. Additionally, the values of the filtering capacitor and resistor would allow more power to be supplied to the LEDs than that used for the non-nightlight embodiment.

BRIEF DESCRIPTION OF THE DRAWINGS

The present invention is illustrated with 8 drawings on 7 sheets.

DETAILED DESCRIPTION OF THE DRAWINGS

The following descriptions are not meant to limit the invention, but rather to add to the summary of invention, and illustrate the present invention, an Illuminated Duplex Receptacle. The present invention is illustrated with a variety of drawings showing various possible embodiments.

Figure 1:
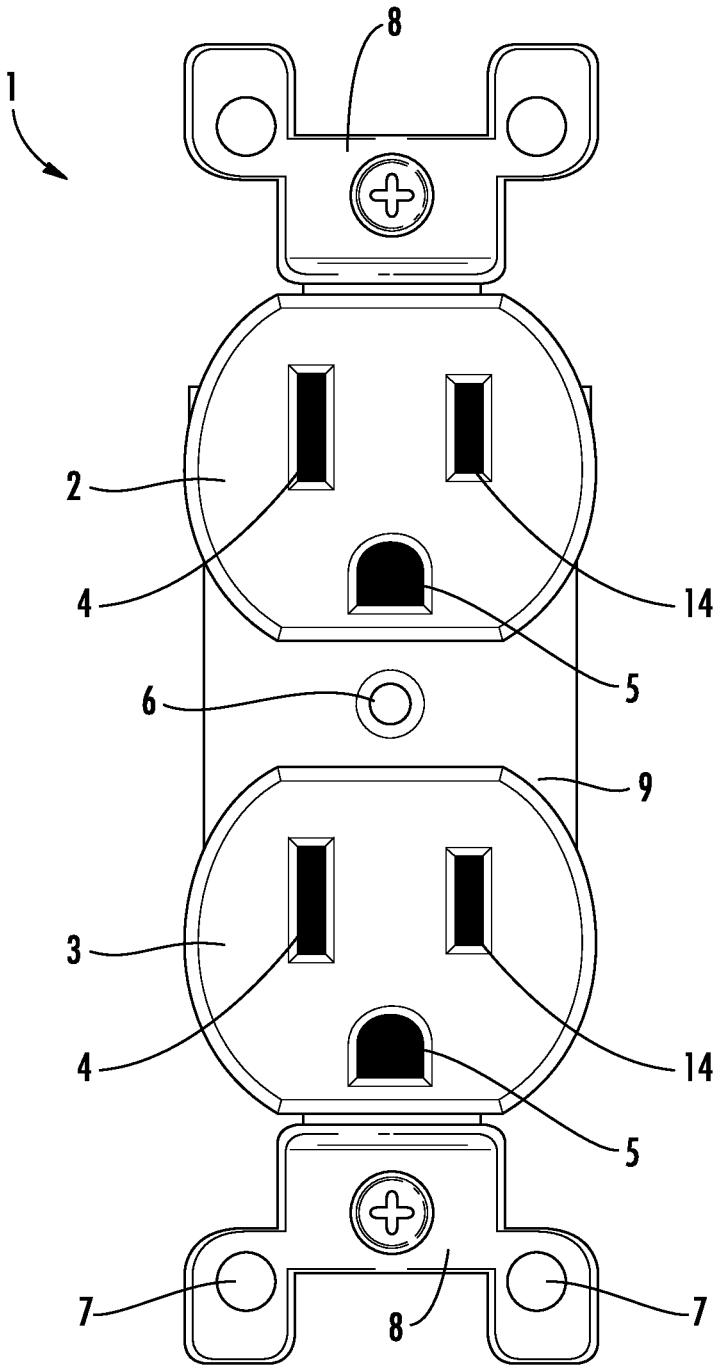
FIG. 1 is a front view of a standard duplex receptacle.
Figure 3:
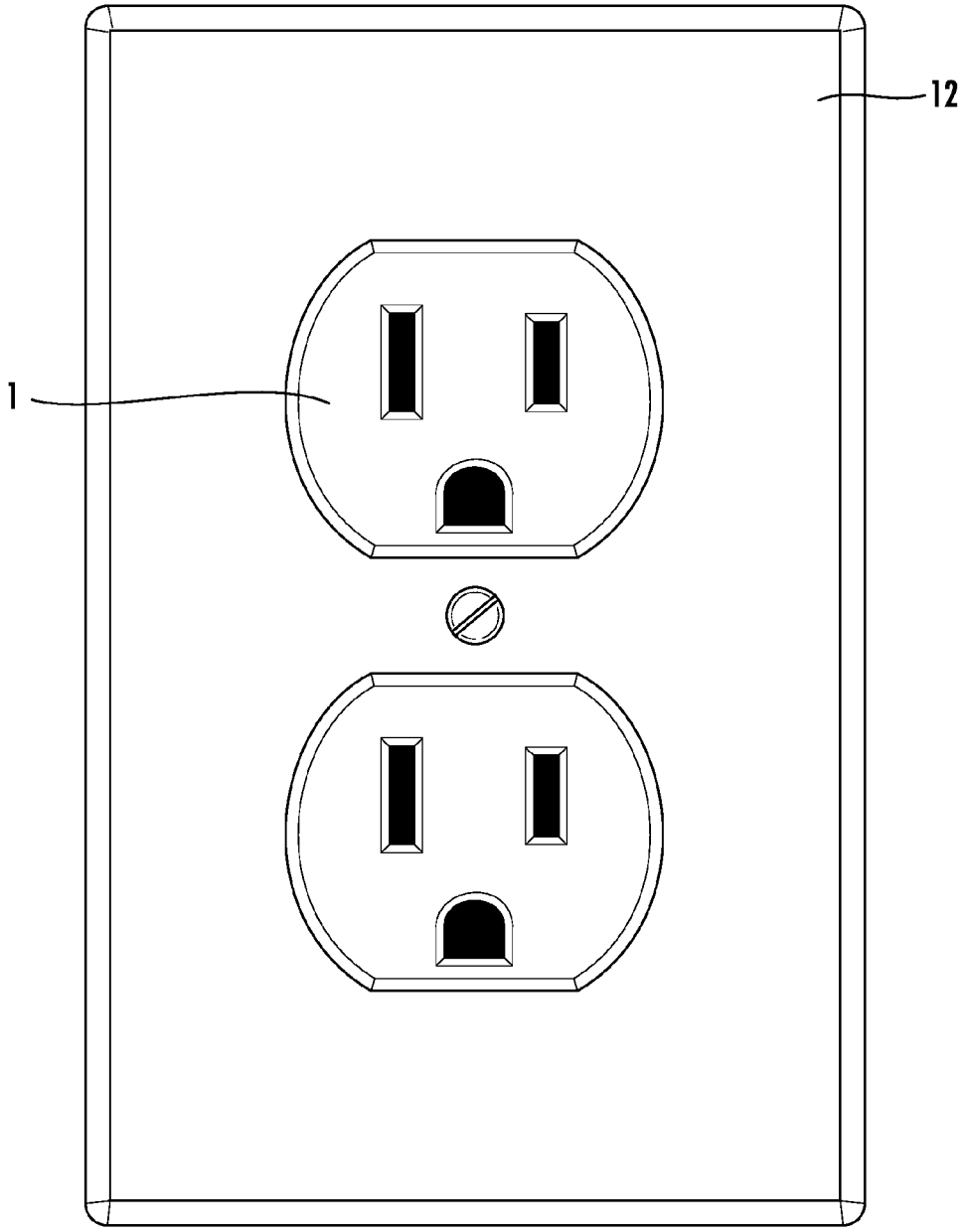
FIG. 3 is an in situ front view of a standard duplex receptacle.

FIG. 1 shows a front view of a standard duplex receptacle 1. FIG. 3 shows the standard duplex receptacle 1 with a faceplate 12. The standard duplex receptacle 1 has an upper set of sockets 2 and a lower set of sockets 3. The upper set of sockets 2 has a socket face 2. The lower set of sockets 3 has a socket face 3. Each set of sockets has a larger slotted receiving socket 4, a smaller slotted receiving socket 3, and an arch-shaped receiving socket 5. The standard duplex receptacle has a center-hole 6, in which to screw a faceplate 12. The standard duplex receptacle has two mounting tabs 8, with mounting holes 7. There is a planar space 9 between the upper set of sockets 2 and the lower set of sockets 3.

The prongs of a standard plug (not shown) fit snuggly in the receiving slots 4, 14, 5. The larger slotted receiving socket 4 is connected to the neutral household wiring. The smaller slotted receiving socket 14 is connected to the hot household wiring.

Figure 2:
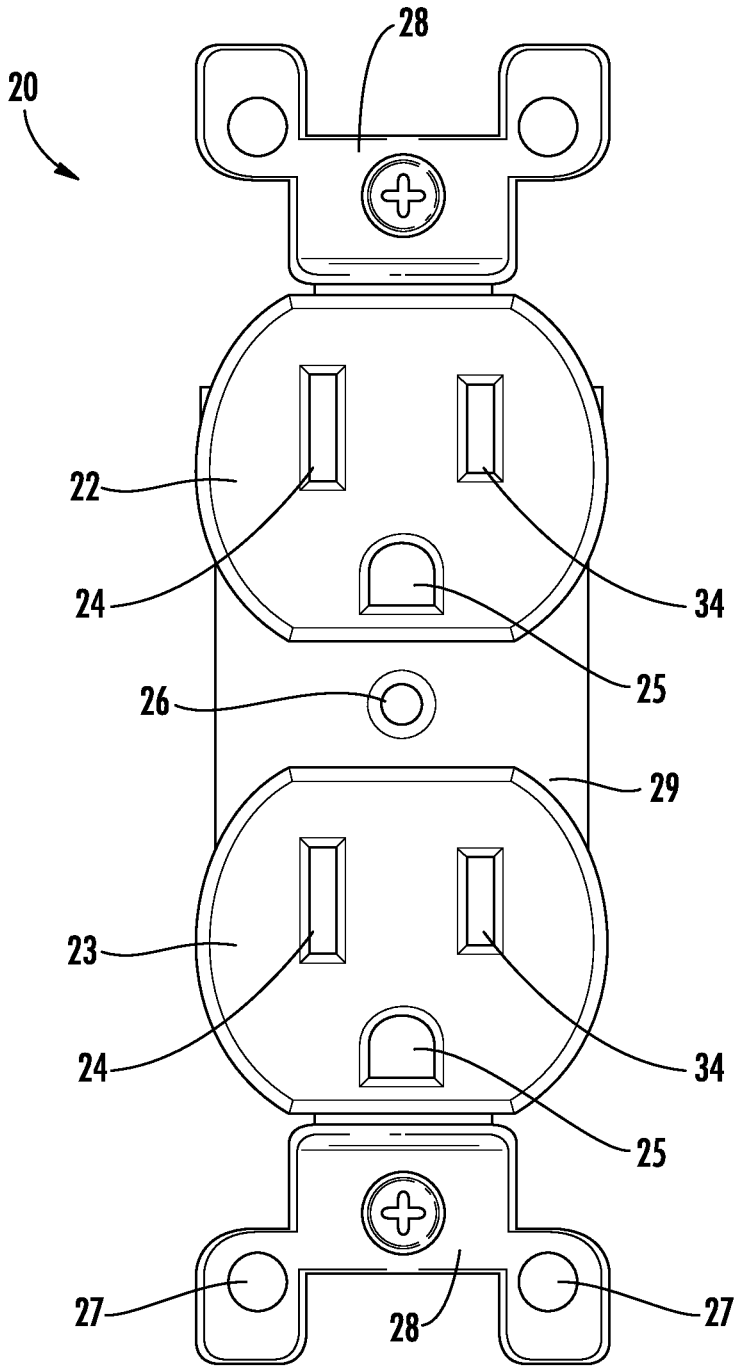
FIG. 2 is a front view of the present invention.
Figure 4:
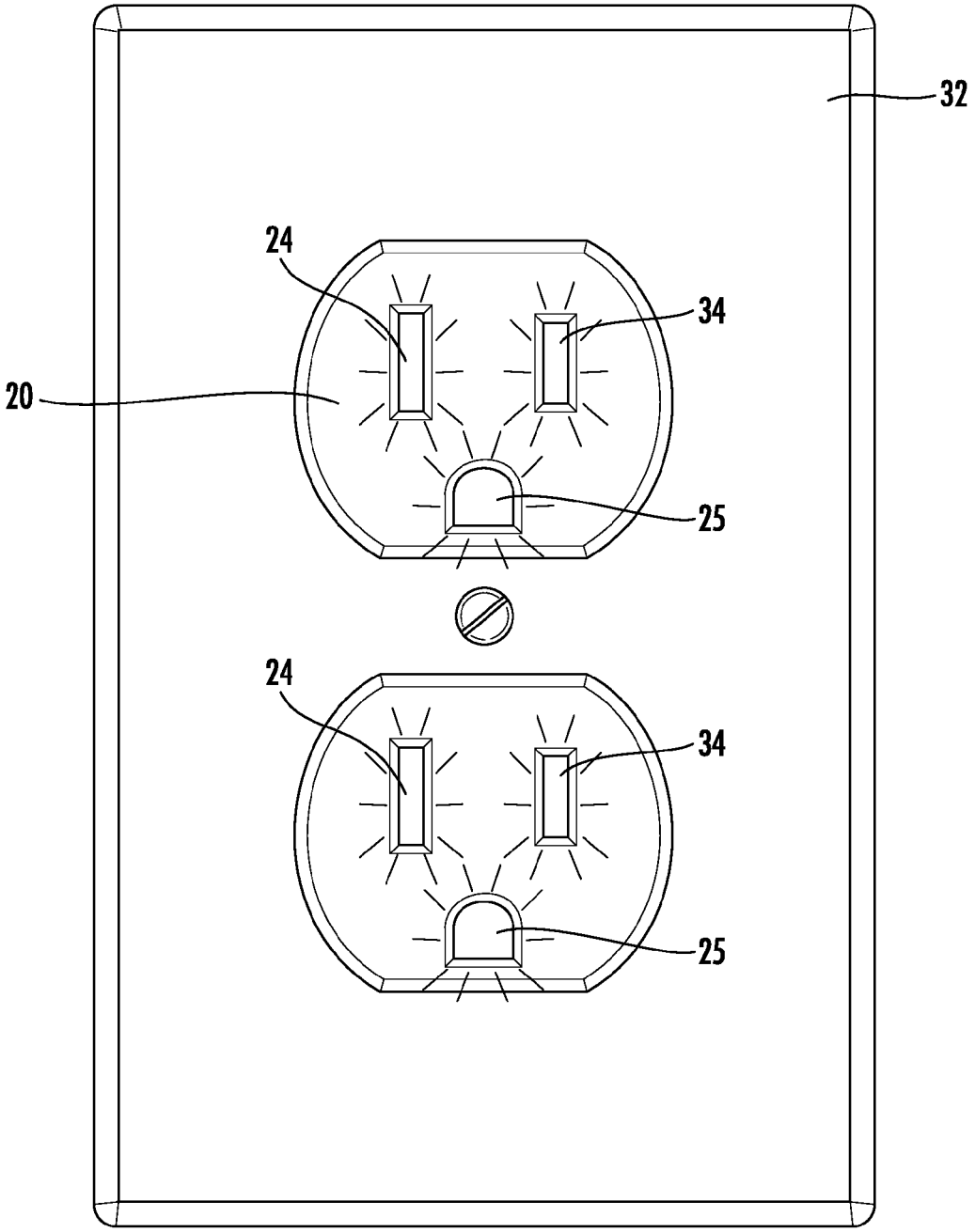
FIG. 4 is an in situ front view of the present invention.

FIG. 2 shows a front view of the present invention, an Illuminated Duplex Receptacle 20. FIG. 4 shows the Illuminated Duplex Receptacle 20 with a faceplate 32. The Illuminated Duplex Receptacle 20 is similar to the standard duplex receptacle 1. The Illuminated Duplex Receptacle 20 has an upper set of sockets 22 and a lower set of sockets 23. The upper set of sockets 22 has a socket face 22. The lower set of sockets 23 has a socket face 23. Each set of sockets has a larger slotted receiving socket 24, a smaller slotted receiving socket 34, and an arch-shaped receiving socket 25. The Illuminated Duplex Receptacle 20 has a center-hole 26, in which to screw a faceplate 32. The Illuminated Duplex Receptacle 20 has two mounting tabs 28, with mounting holes 27. There is a planar space 29 between the upper set of sockets 22 and the lower set of sockets 23.

The prongs of a standard plug (not shown) fit snuggly in the receiving slots 24, 34, 25. The larger slotted receiving socket 24 is connected to the neutral wire or terminal. The smaller slotted receiving socket 34 is connected to the hot wire or terminal.

Figure 5A:
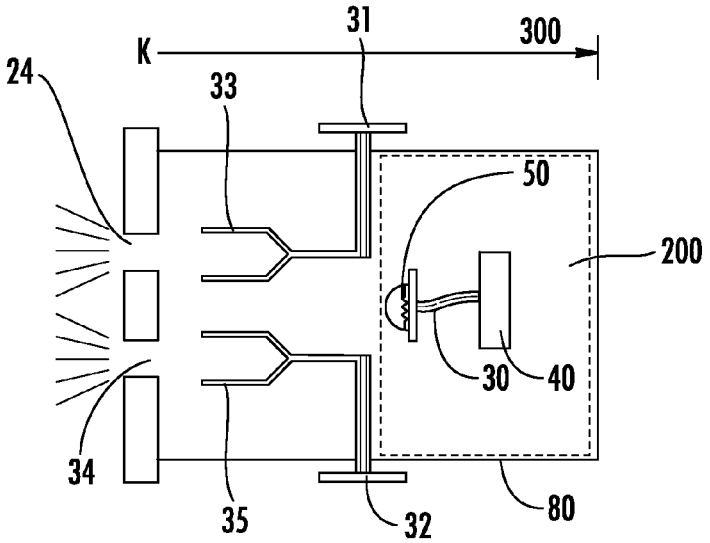
FIG. 5A is a top view cross-section of the present invention.
Figure 5B:
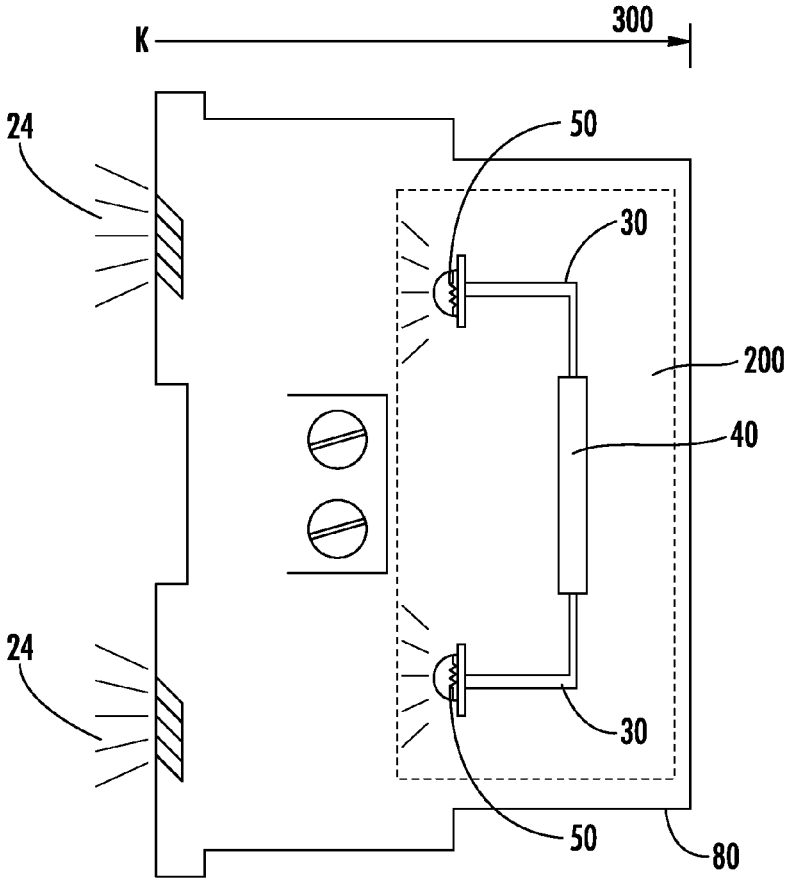
FIG. 5B is a side view cross-section of the present invention.

FIG. 5A is a horizontal cross-section of the Illuminated Duplex Receptacle 20; FIG. 5B is a vertical cross-section of the Illuminated Duplex Receptacle 20. Behind each slotted receiving socket 24, 34 is an electrode 33, 35. The neutral electrode 33 is connected to the neutral terminal 31. The hot electrode 35 is connected to the hot terminal 32. Behind each electrodes 33, 35 is a LED 50. The LED 50 is connected to a circuit 40 with an electrical connection 30. In practice, the electrical connection 30, circuit 40, and LED 50 can all be placed on a single printed circuit board ("PCB"). The entire LED assembly 200 fits behind the electrodes 33, 35. The electrodes 33, 35, electrical connection 30, circuit 40, and LED 50 are all inside a housing 80. The housing 80 depth 300 meets the NEMA specification for the standard duplex receptacle.

Figure 6:
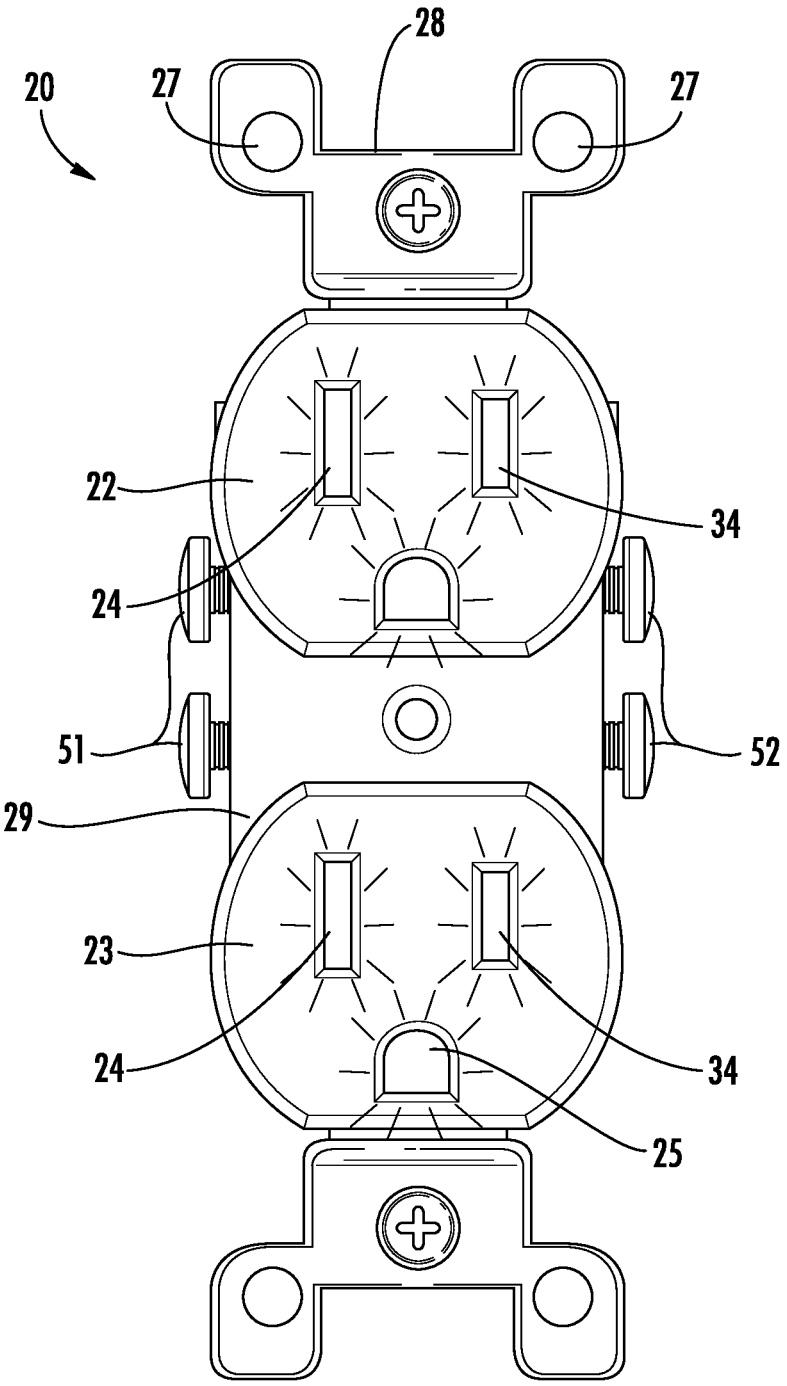
FIG. 6 is a front view of an alternative embodiment of the present invention.

FIG. 6 shows the Illuminated Duplex Receptacle 20. The Illuminated Duplex Receptacle 20 has an upper set of sockets 22 and a lower set of sockets 23. The upper set of sockets 22 has a socket face 22. The lower set of sockets 23 has a socket face 23. Each set of sockets has a larger slotted receiving socket 24, a smaller slotted receiving socket 34, and an arch-shaped receiving socket 25. The Illuminated Duplex Receptacle 20 has a center-hole 26, in which to screw a faceplate 32. The Illuminated Duplex Receptacle 20 has two mounting tabs 28, with mounting holes 27. There is planar space 29 between the upper set of sockets 22 and the lower set of sockets 23.

The prongs of a standard plug (not shown) fit snuggly in the receiving slots 24, 34, 25. The larger slotted receiving socket 24 is connected to the neutral voltage wire. The smaller slotted receiving socket 34 is connected to the hot voltage wire. There are two sets of terminals 51, 52. One set of terminals 51, 52 is used when the Illuminated Duplex Receptacle 20 is the last outlet on a circuit. Both sets of terminals 51, 52 are used when the Illuminated Duplex Receptacle 20 is not the last outlet on a circuit. In this case, one set of terminals 51, 52 (e.g., 51) energizes the Illuminated Duplex Receptacle 20, while the other set of terminals 51, 52 (e.g., 52) feeds the remainder of the circuit (not shown). In an alternative embodiment, one set of terminals 51, 52 can be dedicated for supplying power to the LED circuit 40.

Figure 7:
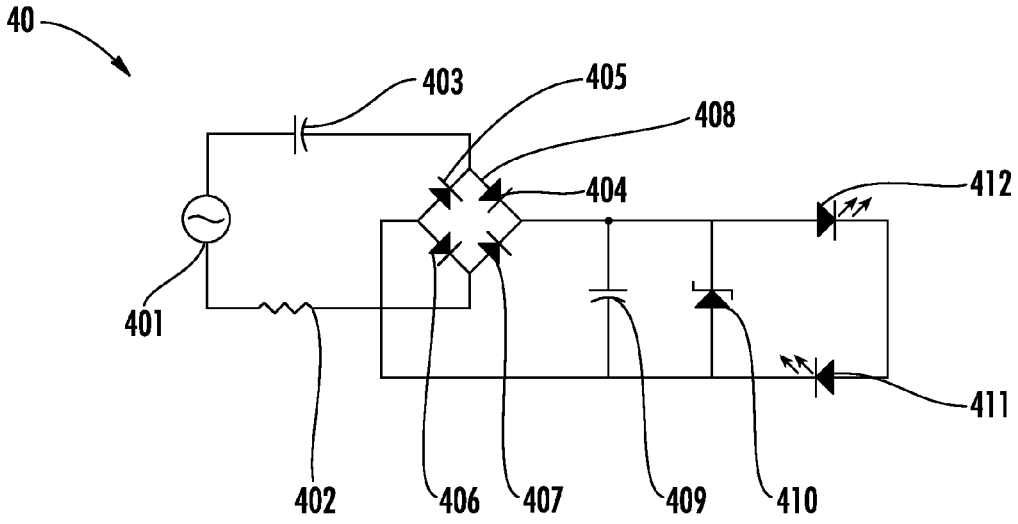
FIG. 7 is a simple circuit diagram of the LED circuit of the present invention.

FIG. 7 is an example of a circuit 40 to power the LEDs 412, 411. Other simple circuits are possible. In this circuit, the ac power source 401, fed by a connection to the terminals 51, 52, is filtered by a capacitor 403 and resistor 402. The power delivered to the LEDs 412, 411 is dictated by the filtering capacitor 403 and resistor 402. If the capacitor 403 has relatively low capacitance, relatively less energy will be delivered to the LEDs 412, 411. Likewise, if the resistor 402 has a relatively large resistance, relatively less energy will be delivered to the LEDs 412, 411.

The LEDs 412, 411 are powered by a capacitor 409 coupled rectifier 408. The rectifier 408 has four diodes 404, 405, 406, 470, a capacitor 409, and a zener diode 410. By selecting the appropriate values for the filtering capacitor 403 and resistor 402, the power delivered to the LEDs 412, 411 can be limited to one-quarter of a watt, or less. The LEDs 412, 411 and the remainder of the circuit 40 can be included on a single PCB 200.

In an alternative embodiment, the housing 80 and faces 22, 23, can be fabricated from translucent plastic, in order to use the Illuminated Duplex Receptacle 20 as a nightlight. In such a case, by selecting the appropriate values for the filtering capacitor 403 and resistor 402, the power delivered to the LEDs 412, 411 can be increased to one watt, or more. An optional photosensor can be included to shut off the LED circuit 40.

We claim:

1. An illuminated duplex receptacle comprising: a housing with an upper face and a lower face, wherein the upper face has a plurality of sockets and wherein the lower face has a plurality of sockets;

a plurality of electrodes, interior to the housing and in proximity to the plurality of sockets;

wherein a standard plug prong, inserted through one of the plurality of sockets, snuggly engages the electrode interior to, and in proximity with, that socket;

at least one set of terminals electrically connected to the electrodes;

an LED assembly containing at least two LEDs, wherein at least one LED is centered about the sockets for the upper face and at least one LED is centered about the sockets for the lower face;

wherein the LEDs receive one-quarter watt or less of continuous power, through the LED assembly, wherein the LED assembly is powered by an electrical connection to at least one set terminals; and wherein the electrodes are interposed between the LEDs and the sockets.

2. The illuminated duplex receptacle in claim 1, wherein the LED assembly includes the LEDs, a printed circuit board ("PCB"), at least one capacitor, at least one resistor, at least four diodes, and at least one zener diode.

3. The illuminated duplex receptacle in claim 1, wherein one set of terminals is dedicated to powering the LED assembly.

4. The illuminated duplex receptacle in claim 1, wherein the LEDs are white in color.

5. The illuminated duplex receptacle in claim 1, wherein the LEDs are red in color.

6. The illuminated duplex receptacle in claim 1, wherein the LEDs are green in color.

7. The illuminated duplex receptacle in claim 1, wherein the LEDs are blue in color.

8. An illuminated duplex receptacle comprising: a translucent housing with an upper face and a lower face, wherein the upper face has a plurality of sockets and wherein the lower face has a plurality of sockets;

a plurality of electrodes, interior to the housing and in proximity to the plurality of sockets;

wherein a standard plug prong, inserted through one of the plurality of sockets, snuggly engages the electrode interior to, and in proximity with, that socket;

at least one set of terminals electrically connected to the electrodes;

an LED assembly containing at least two LEDs, wherein at least one LED is centered about the sockets for the upper face and at least one LED is centered about the sockets for the lower face;

wherein the LEDs receive one watt or more of continuous power, through the LED assembly, wherein the LED assembly is powered by an electrical connection to at least one set terminals;

wherein the translucent housing allows light from the LEDs to radiate out of the illuminated duplex receptacle; and wherein the electrodes are interposed between the LEDs and the sockets.

9. The illuminated duplex receptacle in claim 8, wherein the LED assembly includes the LEDs, a printed circuit board ("PCB"), at least one capacitor, at least one resistor, at least four diodes, and at least one zener diode.

10. The illuminated duplex receptacle in claim 8, wherein one set of terminals is dedicated to powering the LED assembly.

11. The illuminated duplex receptacle in claim 8, wherein the LEDs are white in color.

12. The illuminated duplex receptacle in claim 8, wherein the LEDs are red in color.

13. The illuminated duplex receptacle in claim 8, wherein the LEDs are green in color.

14. The illuminated duplex receptacle in claim 8, wherein the LEDs are blue in color.

* * * * *